US007473330B2

(12) United States Patent
Ryf et al.

(10) Patent No.: US 7,473,330 B2
(45) Date of Patent: Jan. 6, 2009

(54) METHOD FOR PRODUCING A FUNCTIONAL, HIGH-ENERGETIC MATERIAL

(75) Inventors: Kurt Ryf, Wimmis (CH); Beat Vogelsanger, Thun (CH); Ulrich Schaedeli, Plasselb (CH); Bruno Ossola, Faulensee (CH)

(73) Assignee: Nitrochemie Wimmis AG, Wimmis (CH)

( * ) Notice: Subject to any disclaimer, the term of this patent is extended or adjusted under 35 U.S.C. 154(b) by 542 days.

(21) Appl. No.: 09/879,187

(22) Filed: Jun. 13, 2001

(65) Prior Publication Data

US 2002/0043316 A1 Apr. 18, 2002

(30) Foreign Application Priority Data

Jun. 15, 2000 (EP) ..... 00810520

(51) Int. Cl.
*C06B 45/12* (2006.01)
*D03D 23/00* (2006.01)
*D03D 43/00* (2006.01)

(52) U.S. Cl. ..... 149/14; 149/109.4; 149/109.6

(58) Field of Classification Search ..... 149/14, 149/109.4, 109.6
See application file for complete search history.

(56) References Cited

U.S. PATENT DOCUMENTS

| | | | | |
|---|---|---|---|---|
| 2,337,943 | A | 12/1943 | Silk | |
| 2,349,048 | A | 5/1944 | Mackey et al. | |
| 2,771,351 | A | 11/1956 | Holmes et al. | |
| 3,037,891 | A | 6/1962 | Maag | |
| 3,108,916 | A * | 10/1963 | Coffee et al. | 149/11 |
| 3,290,190 | A | 12/1966 | Godfrey et al. | |
| 3,779,826 | A | 12/1973 | Shaver | |
| 4,963,296 | A | 10/1990 | Niedermeier et al. | |
| 5,043,031 | A | 8/1991 | Redecker et al. | |
| 5,520,757 | A | 5/1996 | Lutz | |
| 5,682,009 | A | 10/1997 | O'Meara et al. | |
| 6,042,663 | A | 3/2000 | Evans et al. | |
| 6,309,484 | B2 | 10/2001 | Langlotz et al. | |
| 6,444,062 | B2 | 9/2002 | O'Meara et al. | |

FOREIGN PATENT DOCUMENTS

| | | |
|---|---|---|
| CA | 2298513 | 8/2000 |
| EP | 1 031 548 | 12/1999 |
| WO | WO 98/34891 | 8/1998 |
| WO | 00/03960 | 1/2000 |

OTHER PUBLICATIONS

Cartwright, "Volatility of NENA and other energetic plasticizers determined by theromogravimetric analysis" Chemical Abstracts, vol. 122, No. 4,Jun. 12, 1955, p. 233.
Lu et al, "Preliminary study of BuNENA gun propellants" Chemical Abstracts, vol. 125, No. 16, Oct. 14, 1996, p. 283.
Vogelsanger et al "EI-technology. The key for high-performance propulsion design", Chemical Abstracts, vol. 129, No. 9, Aug. 31, 1998, p. 811.
Gautem et al Study of energetic nitramine extruded double-base propellants, vol. 130, No. 8, Feb. 22, 1999, p. 887.
http://www:Google.ch/search?hl=water+insoluble+polyester &meta, last accessed Mar. 16, 2007 and "google Extract".
http://www:Google.ch/search?hl+de&q+water+soluble+polyester &meta.

* cited by examiner

*Primary Examiner*—Michael A Marcheschi
*Assistant Examiner*—James E McDonough
(74) *Attorney, Agent, or Firm*—Birch, Stewart, Kolasch & Birch, LLP

(57) ABSTRACT

The method for producing a propellant powder (TLP) with a layered grain structure starts with a green powder, which is impregnated in a watery emulsion with an energetic plasticizer and a polymeric deterrent. Propellant powders (TLP) can be produced in industrial quantities by avoiding the dangerous direct introduction of a blasting oil. The propellant powders (TLP) produced in this way have similar characteristics and a similar structure as the known propellant powders (TLP).

17 Claims, No Drawings

METHOD FOR PRODUCING A FUNCTIONAL, HIGH-ENERGETIC MATERIAL

TECHNICAL FIELD

The invention a method for producing a functional, high-energetic material with layered grain structure that contains a high-energy plasticizer and a polymeric deterrent. The invention furthermore relates to a material of this type.

PRIOR ART

Knowledge gained in recent years in connection with international military conflicts revealed the necessity for a new orientation, which is particularly important in the area of mobile weapon systems in the mid-caliber range (caliber size between 12-50 mm). Increases in the performance that must be obtained through new developments in weapon technology are very expensive because massive improvements in the area of material technology are necessary to successfully withstand the resulting higher maximum gas pressures.

For cost reasons alone, a high interest exists in the field of weapons technology to achieve the desired performance increases with previously introduced existing weapons platforms. One innovative concept in this connection is based on a family of new types of sub-caliber ammunition (frangible, arrow-shaped). This ammunition achieves its desired impact on the target through a conversion of kinetic energy alone, meaning without additional explosive materials. Yet, this new type of ammunition can be fired from standard weapons. The muzzle speed, meaning the speed at which the ammunition component leaves the weapon tube or the kinetic energy with which the projectile hits the target, is vitally important since this new type of ammunition uses only the kinetic projectile energy to achieve the desired impact on the target. The higher the muzzle speed, the more effective the impact on the target due to the fact that the loss of speed is very low (very low Cd value, wherein Cd is aerodynamic drag factor), in particular with kinetic projectiles of this type. Shortening the flight time and the stabilization of the flight trajectory are additional and important positive aspects, resulting from a high muzzle speed. In addition, this results in lower wind sensitivity and an increase in the first-hit probability.

New types of propellants (TLP) are necessary in the field of weapons technology to achieve the muzzle speeds required for the above-described, new types of sub-caliber high-performance ammunition. As compared to the monobasic propellants with a nitrocellulose base, these new types of propellants can transmit a higher kinetic energy to the ammunition component. The problem with providing the required, new high-performance propellants is that undesirable side effects must be avoided. That is to say, the full, expanded system compatibility with respect to the tube (erosion, corrosion), the weapon (maximum gas pressures, cadence) and the environment (avoiding formula components that are problematic for the environment) must be ensured for the required, increased performance level. In addition, it should not be necessary to reduce the ballistic stability, meaning the length of time during which the ammunition filled with propellant can be fired safely and conforming to the requirements, as compared to the conventional propellants. Finally, it is desirable to produce the required high-performance propellants cost-effectively, meaning to start with easy to obtain, low-priced basic materials and, in particular, not to require involved processing steps (e.g. the roller techniques for multi-base propellants).

To be sure, high muzzle speeds can be achieved with propellants containing larger amounts of crystalline explosives such as hexogen, octogen or CL-20 (nitramine powder), but the tube service life in the process is reduced to an unacceptably low number of firings. The reason for this undesirable effect is that the flame temperature of the burning gases in the weapon barrel is extremely high due to the high energy content of the propellant, as well as the high hydrogen content in the resulting burning gases.

Another approach for increasing the energy content consists in adding a suitable, highly energetic blasting oil to the grain matrix. The so-called spherical propellant powders be mentioned first in this connection. However, the maximum size for the spherical propellant particles is limited. These powder types consequently have high-explosive properties and their technical importance above all lies in the small caliber range. In addition, these propellants mostly have a strongly reduced ballistic and chemical stability as compared to monobasic propellants.

So-called dibasic propellants are known from the U.S. Pat. No. 4,963,296. They represent a second type of propellant that contains blasting oil incorporated into the grain matrix. However, these propellants are very costly due to the involved production method. In addition, this propellant type causes strong tube erosion for mid-caliber applications and is consequently of little technical importance in this area.

New types of functional, highly energetic materials are described in the publication by B. Vogelsanger and K. Ryf, Int. Annu. Conf. ICT (1998), 29$^{th}$ Edition (Energetic Materials), 38.1-38.14. These materials do not exhibit the above-mentioned disadvantages owing to a functional, layered composition of the grain matrix. Based on these new types of functional materials, a new generation of high-performance propellants is now available. Among other things, these propellants can be used successfully as drive components for sub-caliber high-performance ammunition, thus making it possible to achieve the high muzzle speeds required by technology. The advantageous characteristics of this new generation of propellants are achieved through a purposeful, layered composition of the cylinder-shaped propellant grain, for which the energetic plasticizer(s) or blasting oils and a polymeric deterrent are located in the desired outer 100-500 micrometers of the propellant grain. A share of the blasting oil is additionally located in the perforation zones of the propellant. Owing to the specially adjusted layered composition, propellants were made available for the first time, which have a special, purposely controlled burning behavior that introduces several positive properties. Thus, unacceptably high maximum gas pressures can be avoided since the burning behavior is advantageously influenced through the layered composition of the outside and inside zones of the propellant grain. As a result of this characteristic, the energy content of these functional materials can be converted better to kinetic muzzle energy. By using the option of deliberately adapting the distribution profiles for blasting oil and deterrent, it is possible to realize propellants with an optimum burning behavior for different caliber sizes. As a result, a maximum flexibility with respect to the adaptation to different weapon types and ammunition types is made possible. The propellant powders consequently have a high kinetic muzzle energy and a high thermal degree of effectiveness.

The layered composition of the outer skin and the inside zones of this new type of propellant powder furthermore result in a burning behavior, which is mostly independent of the temperature of the propellant body. It means that within a broad temperature range, similarly high muzzle speeds and maximum gas pressures are the result. As a result, a similarly high muzzle energy is available independent of the environmental temperature at which the ammunition is fired, meaning the propellant behavior is mostly independent of the temperature.

Finally, the functional materials have very high bulk densities. The bulk density is a measure for the propellant weight that can be stored inside a specific volume unit and is typically expressed as unit $g_{TLP}/1$. This positive characteristic is extremely important since the case volume for a given ammunition component is predetermined. The more propellant can be placed inside this predetermined case volume, the higher the potential that can be converted to kinetic energy. With a comparable maximum gas pressure, for example, the muzzle energy can be increased up to 12% as compared to conventional, monobasic propellants.

REPRESENTATION OF THE INVENTION

It is the object of the invention to provide a method of the aforementioned type, which permits a precise adjustment of the layer structure.

This object is solved with the features in claim 1. According to the invention, the plasticizer and/or the deterrent are diffused in the form of a watery emulsion into the absorptive (non-impregnated) grain, meaning into the so-called green or unprocessed powder.

The invention is based on the surprising finding that during the production, the functional materials can also be impregnated in a watery emulsion, wherein propellants with the desired layered composition are obtained as well. The present invention thus includes the process of impregnating an unprocessed, monobasic green powder in a watery emulsion, as well as the subsequent finishing to produce the functional propellant with a layered composition.

Thus, the invention differs clearly from the known methods, which generally use so-called polishing drums for the impregnation, as a means to purposely adjust the layered distribution of the blasting oil and the deterrent. With these known methods, a liquid impregnating substance (or if necessary a solution of a solid impregnating substance dissolved in a suitable solvent) is added to a non-impregnated propellant charge (green powder). In the process, the impregnating substance is diffused into the propellant grain through the rotational effect and at an increased temperature. The method according to the invention avoids the problem that would develop with these known methods when diffusing in highly sensitive blasting oils such as nitroglycerin [glycerol trinitrate] as a result of acute safety risks. This problem would make it considerably more difficult, if not impossible, to produce larger amounts of the functional high-energy materials.

The impregnation method can be carried out in a 2-stage process or a 1-stage process. For the 2-stage process, the green grain is initially treated in a watery emulsion with the blasting oil. At the conclusion of the exposure time, the excessive emulsion is pumped off. The liquid components in the reactor can be strained through a strainer. In an additional process step, the propellant powder mass (remaining inside the reactor), is exposed to a watery emulsion containing the polymeric deterrent, which permits a good control of the process parameters.

In the same way as for the 2-stage process, the green propellant is initially treated during the 1-stage process with a watery emulsion of the blasting oil. At the conclusion of the exposure time, however, the remaining emulsion is not separated from the propellant but is used further by adding the polymeric deterrent. The concentration profiles can be changed purposely by varying the time intervals for adding the blasting oil or the polymeric deterrent, as well as the point in time for adding them. The 1-stage process involves fewer process steps and is therefore more economical.

Auxiliary agents (stabilizers and/or wetting agents) can be added as needed to the watery emulsion during the 1-stage process as well as the 2-stage process. These auxiliary agents suppress among other things the formation of foam, stabilize the emulsion or can purposely influence the penetration behavior of the effective components.

The following table illustrates the advantages of propellants with a layered composition, as compared to a conventional, monobasic propellant. It is obvious that the new production processes to be patented result in propellants, which have similarly advantageous properties as the materials described in the EP 0 960 083 A1. That is to say, a markedly increased performance potential can be realized across the complete temperature range under weapons-compatible conditions (compare Table 1).

| Propellant type | number of holes | explosion heat | bulk density | $V_0(P_{max})$ 21° C. | muzzle energy 21° C. | $V_0(P_{max})$ temperature | muzzle energy temperature | $V_0(P_{max})$ temperature | muzzle energy temperature |
|---|---|---|---|---|---|---|---|---|---|
| Propellant according to Example 1 | 7 | 3999 | 1062 | 1438 m/s (4433 bar) | 1271 J/g | 1416 m/s (4243 bar) −32° C. | 1240 J/g −32° C. | 1442 m/s (4496 bar) 62° C. | 1285 J/g 62° C. |
| Conventional Monobase | 7 | 3650 | 1000 | 1381 m/s (4134 bar) | 1191 J/g | 1320 m/s (3399 bar) −30° C. | 1089 J/g −30° C. | 1411 m/ (4420 bar) 50° C. | 1244 J/g 62° C. |
| gain in muzzle energy with propellant according to example as compared to convent. Propellant | | | | | 7% | | 14% | | 3% |

Another aspect of the present invention is that it makes available new types of functional materials with improved characteristics as compared to the above-described materials. With the materials described in B. Vogelsanger and K. Ryf, Annu. Conf. ICT (1998), 29$^{th}$ Edition (Energetic Materials), 38.1-38.14, only blasting oils such as nitroglycerin are used for the impregnation. However, these are known to have several disadvantages. One such disadvantage is the extremely high sensitivity of these blasting oils. Nitroglycerin and dinitro-diglycol respectively have a sensitivity to impact of only 0.2 Nm, which makes it extremely difficult and restricts the handling of these materials during the processing. Another disadvantage of these blasting oils is the high-energy content (explosion heat), which is 6542 J/g for nitroglycerin and 4527 J/g for dinitro diglycol. If the propellant contains larger amounts of these blasting oils, the flame temperature during the burning increases, thus leading to an increase in the tube erosion.

Surprisingly, it was discovered that these blasting oils can be replaced during the impregnation process with energetic plasticizers, which have a lower energy content and advantageous thermodynamic properties and additionally are less sensitive to impact. The resulting new types of propellants surprisingly distinguish themselves through a clearly improved Vo/Pmax ratio, meaning higher muzzle speeds can be realized if the pressure reserves are used. In addition, functional materials of this type also exhibit a favorable $\Delta Vo_{gTLP}/\Delta Pmax_{gTLp}$ ratio. That is to say, for each gram additional charge, the muzzle speed relative to the pressure increases faster than for propellants on the basis of blasting oils. This effect is illustrated in the following with the example 3.

A plurality of energetic plasticizers are known for the propellant technology. These include in particular low-molecular, aliphatic nitric acid esters, nitro compounds, nitramines and azides. A particularly suitable material category involves the so-called 2-nitroxyethyl-nitramines (alkyl-NENA) with the general structural formula I, wherein $R_1$represents an aliphatic residue. Another particularly suitable material category involves the so-called dinitro-diaza alkanes with the general formula II, wherein $R_2$ and $R_3$ represent aliphatic residues. The use of substances with the general structure II is known in the propellant powder technology. However, these substances have never before been used in a layer sequence in the propellant matrix, but were distributed homogeneously in the propellant matrix, in the same way as for a dibasic propellant (compare also EP 960083A1). The plasticizers can be inserted separately or as their mixtures into the green grain.

(I)

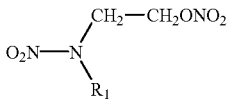

(II)

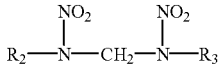

The subject matter of the present invention furthermore involves new types of functional materials, which contain additionally a crystalline energy carrier in the basic matrix of nitrocellulose. Crystalline energy carriers of this type are known per se and include, for example, so-called crystalline nitramines with the general formula III. The residue $R_4$ in this case forms a portion of the ring system and can preferably contain additional units with the structure (—$CH_2$—N—$NO_2$).

(III)

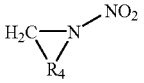

Particularly preferred compounds with the structure III are hexogen IV, octogen V and CL-20 VI.

(IV)

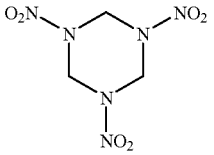

(V)

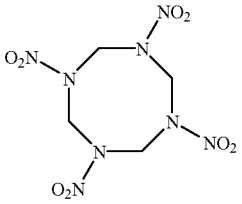

(VI)

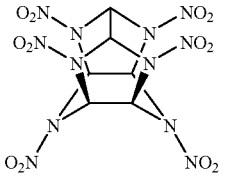

The upper content limit of the crystalline energy carrier follows from the fact that the mechanical strength of the resulting propellant grain is retained even at low temperatures. To detect the expected positive effect with respect to ballistics, the amount should not be lower than approximately 5%. These compounds with the general structure III or mixtures thereof are therefore added in amounts of between 5-80%, preferably 10-50%, of the total powder mass to the nitrocellulose matrix and are distributed homogeneously in the completed grain. Propellants that are pretreated in this way (and functionally correspond to the green powder) are subsequently treated with an energetic plasticizer and a deterrent during an impregnation process, which results in the previously described layered grain structure and is also a component of the present invention. The advantage of these layered, functional materials is that they have a higher energy content as compared to functional materials, which do not contain a crystalline energy carrier in the grain matrix. Thanks to the special layered composition, this higher energy content can be converted optimally to kinetic energy, in a manner compatible with the system.

The invention can be described as follows, summed up in key words:

1) Impregnation process: Treatment in watery emulsion of a "green powder" of nitrocellulose in an optional form with a blasting oil as energetic plasticizer and a deterrent during a 1-stage or 2-stage process.
2) New types of functional energetic materials with layered composition, produced according to 1), which contain in place of the blasting oil a non-sensitive, energetic plasticizer of the Type I or II, or mixtures thereof, as well as the production process in a watery emulsion and their uses as propellant.

3) New types of functional, energetic materials, produced according to 1) or 2), which additionally contain a crystalline energy carrier of the type III, distributed homogeneously in the grain matrix, the method for producing these materials in a watery emulsion and their use for the production of propellants.

The impregnating process for producing highly energetic functional materials is described in the following. The impregnation process starts with untreated green powder in an optional form, which essentially consists of nitrocellulose with a N-content of between 11-13.5%. The green powder used can contain, if necessary, admixtures known from the powder technology as stabilizers, tube protectors, plasticizers and firing flash damping agents. Known admixtures that are suitable for use can include the following for increasing the stability: sodium hydrogen carbonate (CAS#: 144-55-8), calcium carbonate (CAS#: 471-34-1), magnesium oxide (CAS#: 1309-48-4), acardit II (CAS#: 724-18-5), centralit I (CAS#: 90-93-7), centralit II (CAS#: 611-92-7) 2-nitrodiphenylamine (CAS#: 836-30-6) and diphenylamine (CAS#: 122-39-4). The following may be used as plasticizers: diethylphthalat (CAS#: 84-66-2), camphor (CAS#: 76-22-2), dibutylphthalat (CAS#: 84-74-2), di-n-propyl adipate (CAS#: 106-19-4) or methylphenyl urethane (CAS#: 261-79-6). The following are used, for example, for the tube protection: magnesium oxide (CAS#: 1303-48-4), molybdenum trioxide (CAS #: 1313-27-5), magnesium silicate (CAS #: 14807-96-6), calcium carbonate (CAS #: 471-34-1) or titanium oxide (CAS #: 13463-67-7) and for the muzzle flash damping, for example, sodium oxalate (CAS #: 62-76-0), potassium bitarate (CAS #: 868-14-4), sodium hydrogen carbonate (CAS #: 144-55-8) potassium hydrogen carbonate (CAS #: 298-14-6), sodium oxalate (CAS #: 62-76-0), potassium sulfate (CAS #: 7778-80-5) or potassium nitrate (CAS #: 7757-79-1). The green propellant powder can furthermore contain additional known admixtures, for example for improving the ignition behavior and changing the burning behavior. The aforementioned admixtures are all added during the green grain production to the powder dough, meaning they are distributed evenly in the grain matrix. The total amount of these admixtures in the green grain is between 0-20% as compared to the nitrocellulose and preferably between 5-15%.

The green powder typically is a cylinder-shaped one-hole or multi-hole propellant with a ratio for the grain diameter/grain length of between 0.5-2.0, preferably 0.9-1.5. The outside diameter of the green powder is between 0.5-10 mm, preferably 0.5-5 mm. The hole diameters are in the range of between 0.03-0.7 mm. The green grain can be obtained in a manner known per se by extruding solvent-containing propellant dough in a press or by means of extrusion.

The production method according to the invention can be a one-stage method or a two-stage method. The impregnation process initially is to be explained with the 2-stage method. The above-described green powder is poured into a metal reactor tank equipped with an intake valve in the cover, a bottom outlet valve, mechanical and static flow inserts and vacuum connections. The tank is provided with 1-5 times the amount of water (relative to the powder amount to be treated). The powder can initially be pre-soaked by stirring it for 4-24 hours at a temperature of 20-85° C. Subsequently, a blasting oil solution is added over a period of 10-60 minutes (approximately 20% in a suitable solvent), wherein the blasting oil component used is in the range of 3-20%, relative to the green grain. The mixture is then allowed to process for 2-8 hours before the pressure is reduced to 400-600 mbar and the solvent is distilled out of the batch. If necessary, the recovered distillate can be recycled as part of the process. Following this, the prepared batch is cooled down and the remaining liquid components are allowed to drain out through the valve in the reactor bottom. The reactor is then again supplied with 1-5 times the amount of fresh water, relative to the powder mass, and the mixture is heated to 80° C. A polymeric deterrent emulsion (approximately 10% in water, share relative to the green grain between 1-5%) is subsequently added over a period of 10-60 minutes. Smaller amounts of auxiliary agents, e.g. for stabilizing the emulsion or increasing the stability of the propellant, can also be mixed into the solutions of blasting oil and the polymeric deterrent that are used. With optimally adjusted stirring conditions (depends on the powder grain), the mixture is allowed to process over a period of 2-6 hours before the batch is again cooled down to room temperature. The remaining liquid components are then allowed to drain out through the valve in the reactor tank bottom, which is provided with a small-mesh screen. The impregnated, functional material remaining in the reactor tank is removed after the screen is removed from the reactor tank and is spread out on fine-meshed metal screens to be dried by warm air flowing through.

The 1-stage process is realized in the same way as the above-described 2-stage process, with the single exception that following the exposure time for the blasting oil solution, the liquid components remain in the reactor and the deterrent emulsion is added directly to it. By varying the adding times, the exposure times and the pressure-lowering moment, the burning characteristic of the finished propellant powder can be influenced purposely.

In practical operations, it has turned out that the control parameters can be adjusted more precisely with the 1-stage process. In addition, the 1-stage process is considerably cheaper because it uses fewer process steps.

The functional material obtained with the above-described 1-step or 2-step method is then finished in a manner known per se by polishing it in a polishing drum with 0.01-2% graphite and, if necessary, additional known auxiliary agents in amounts of 0-4%. In the process, it was surprisingly discovered that the functional materials can be converted during this polishing process to propellants with extraordinarily high bulk densities of 1060-1100 g/l, thus making it possible to place a maximum charge amount into a predetermined casing volume.

Blasting oils suitable for use are nitroglycerin (CAS #: 55-63-0) or diethylene glycol dinitrate (dinitrodiglycol, CAS #: 693-21-0). A plurality of compounds are possible, which can be used as suitable deterrents. On the one hand, the affinity to the nitrocellulose should be such that the deterrent with the suitable solvent as transport means (carrier) can diffuse into the powder grain. On the other hand, no further diffusion can occur once the solvent is removed, which would lead to a change in the distribution profile. Organic ether and ester compounds with a molecular weight of between 100-100,000, preferably between 1000-10,000, have proven to be suitable for this.

A new and so far unknown class of functional energetic materials is obtained if the above-described blasting oils are replaced with less impact-sensitive (simply said: "insensitive") energetic plasticizers with the general structure I or II. On the one hand, it was surprisingly discovered that these new types of functional materials distinguish themselves through a particularly favorable Vo/Pmax ratio. In addition, functional materials of this type have a favorable $\Delta Vo_{gTLP}/\Delta Pmax_{gTLP}$ ratio, meaning that with each charge increase per gram, the muzzle speed relative to the pressure increases faster than for layered propellants on the basis of blasting oils.

Secondly, these insensitive energetic plasticizers lead to a reduction in the heat of explosion by 150-200 J/g, as compared to the traditional blasting oils, which results in a lowering of the flame temperature during the propellant burn-up and thus to an improvement in the tube service life.

In the same way as the above-described production of blasting-oil containing functional materials, the production of the new types of functional materials with energetic plasticizers with the general structures I and II starts with an untreated green grain on the basis of nitrocellulose. The impregnation step in the watery emulsion also progresses in an analog manner, with the single exception that only energetic plasticizers with the general structure I or II or mixtures thereof are used in place of the blasting oils. The following compounds with $R_1$=$C_1$-$C_{10}$-alkyl, $C_1$-$C_{10}$-alkoxy or aryl, $R_2$ and $R_3$, independent of each other $C_1$-$C_5$-alkyl or $C_1$-$C_5$-alkoxy have proven advantageous. Especially preferred are compounds with $R_1$=$C_1$-$C_4$ (methyl, ethyl, n-propyl, i-propyl, n-butyl, i-butyl, t-butyl), $R_2$/$R_3$, independent of each other $C_1$-$C_2$ (methyl, ethyl).

An additional class of so far unknown functional energetic materials is obtained if a crystalline energy carrier with the general formula III is added to the previously described green grain. If necessary, the crystalline energy carriers can be adapted by grinding them to size prior to introducing them into the powder dough or they can be purified, if necessary, through re-crystallization. To achieve a homogeneous distribution of the crystalline energy carrier in the grain matrix, the green grain is produced with known methods, for example extrusion with the aid of static mixers or processing in dual screw-type extruders.

The above-mentioned new types of highly energetic functional materials with a layer-type grain composition are particularly suitable for use as propellant bulk powders for mid-caliber and small caliber uses.

Additional advantageous embodiments and feature combinations of the invention follow from the detailed description below and the complete set of patent claims.

Steps for Realizing the Invention

EXAMPLE 1

Production Process in a Watery Emulsion 200 kg of a 7-hole green propellant with 2.77 mm outside diameter, 3.17 mm length and 0.12 mm hole diameter, composed of the solid components 1.2% acardit-II, 1% calcium carbonate, 0.4% potassium sulfate and 97.4% nitrocellulose with a nitrogen content of 13.15% and produced in the manner known from the propellant technology by compressing a solvent-moistened kneading dough with a die, are mixed with double the amount of water in a 1000 liter steel reactor that is equipped with mechanical vane stirrer, cover intake valve, bottom outlet valve and vacuum connections.

The batch is then heated to a temperature of 85° C. and is pre-soaked for 15 hours under constant stirring and maintaining of the temperature. Following this, a mixture containing 12.5 kg nitroglycerin and 0.25 kg 2-nitrodiphenyl amine, dissolved in 60 liter ethanol, is added drop by drop during a 30-minute interval at a temperature of 80° C. The treatment then continues for 2 ¼hours at an optimum baking mixture setting (propellant powder bed completely suspended). During a 15-minute interval, a suspension containing 1.97 kg of a non-solid polyester that is highly viscous at room temperature and has a molecular weight of 3000 in 30 kg water (the polyester functions as desensitizer) is subsequently added drop by drop. The mixture is then allowed to process for another 2 hours at a temperature of 80° C. and under constant stirring. Following this, the pressure in the reactor tank is slowly reduced to 600 mbar and a portion of the solvent is distilled out of the batch. The vacuum is then broken and the batch cooled down to room temperature. The bottom valve is opened and the remaining liquid components are allowed to drain out. The remaining moist powder mass is stirred continuously with 100 liter fresh water over a period of 2 hours while the heating is turned off. Following this, the liquid components are again drained out through the bottom valve and the remaining moist powder matrix is removed from the reactor. Polymer desensitizers can be organic ethers or esters having a molecular weight of 100-100000.

The moist powder is subsequently spread evenly over large-mesh metal strainers and is dried for 24 hours at 60° C. by warm air flowing through. Finally, the propellant is finished in the polishing drum by adding approximately 0.3% graphite and, if necessary, by treating it with special moderators in a manner known per se.

The completed propellant has an explosion heat of 3999 J/g and its bulk density is 1062 g/liter. At 21° C., a muzzle speed of 1438 m/s can be reached with a 25 mm tube weapon that has a sub-caliber, arrow-shaped projectile weighing 123 g by maintaining the maximum gas pressure permissible for the weapon, which corresponds to a muzzle energy of 1271 $J/g_{TLP}$.

Given the same propellant with the same charge as in the above, a speed of 1416m/s is achieved at −32° C. and a speed of 1442 m/s is achieved at 62° C. In contrast, a conventional, monobasic propellant, fired with the same weapon system as described in the above, having a sub-caliber pointed ammunition weighing 130 g results in a muzzle speed of 1381 m/s at 21° C., which corresponds to a muzzle energy of 1191 $J/g_{TLP}$. At −30° C., the resulting muzzle speed is 1320 m/s and at 50° C., the resulting muzzle speed is 1411 m/s.

EXAMPLE 2

Production Process in a Watery Emulsion

As in Example 1, 200 kg of a 7-hole green powder with 2.57 mm outside diameter, 2.94 mm length and an average hole diameter of 0.16 mm, composed of the solid components 1.2% acardit-II, 0.2% calcium carbonate, 1.4% potassium sulfate and 97.2% nitrocellulose with a nitrogen content of 13.15%, is treated with 14.4 kg nitroglycerin and 3.3 kg of the same type of polyester used in Example 1. The propellant obtained by using the processing method analog Example 1 has a bulk density of 1063 g/l with an explosion heat of 3961 J/g.

With a 20 mm tube weapon and a projectile with a projectile weight of 126 g and a charge weight of 44.5 g, a muzzle speed of 1063 m/s can be achieved at 21° C. and a maximum gas pressure of 4146 bar (maintaining the maximum gas pressure permissible for the weapon), which corresponds to a kinetic muzzle energy of 1601 $J/g_{TLP}$ and a thermal degree of effectiveness of 0.404.

EXAMPLE 3

TLP (propellant) with Energetic Plasticizer

As in Example 2, 200 kg of a 7-hole green propellant with 2.65 mm outside diameter, 3,06 mm length and an average hole diameter of 0.16 mm, composed of the solid components 1.2% acardit-II, 0.2% calcium carbonate, 1.4% potassium sulfate and 97.2% nitrocellulose with a nitrogen content of 13.15%, are treated with 14.4 kg of a mixture of 60% methyl-NENA (compound I, $R_1$=methyl) and 40% ethyl-NENA (compound I, $R_1$=ethyl) as well with 2.8 kg of the same type of polyester used in Example 1. The resulting propellant powder has a bulk density of 1070 g/l with an explosion heat of 3799 J/g.

With a 20 mm tube weapon and a projectile weighing 126 g and having a charge weight of 44.5 g, a muzzle speed of 908 m/s can be achieved at 21° C. while a muzzle speed of 853 m/s can be reached with a charge weight of 42 g. Thus, each additional gram of charge results in a speed increase of 22.0 m/s, with a pressure increase of 116.4 bar, which corresponds to a $\Delta Vo_{gTLP}/\Delta Pmax_{gTLP}$ ratio of 0.19. For the propellant in Example 2, the same ratio only has a value of 0.07. Thus, the speed increase achieved with the propellant in Example 3 when increasing a charge (adding charge) coincides with a clearly lower pressure increase than for the propellant in the Example 2.

EXAMPLE 4

Propellant with Grain Matrix of Nitrocellulose+Crystalline Energy Carrier

As in Example 3, 130 kg of a 7-hole green propellant with 3.00 mm outside diameter, 3.50 mm length, an average hole diameter of 0.17 mm and a density of 1.62 g/ml, composed of the solid components 20.0% RDX (also called hexogen; compare structure IV) with an average grain size of 5 micrometers, 1.0% acardit-II, 0.4% calcium carbonate, 0.6% potassium sulfate, 1% residual solvent and 77% nitrocellulose with a nitrogen content of 12.6%, are treated with 14.4 kg of a mixture of 60% methyl-NENA (compound I, $R_1$=methyl) and 40% ethyl-NENA (compound I, $R_1$=ethyl), as well as with 2.8 kg of a non-solid polyester compound, viscous at room temperature, with an average molecular weight of 3000. The propellant resulting from the processing according to Example 1 has a bulk density of 1071 g/l with an explosion heat of 3795 J/g.

The propellant can be fired from a 25 mm KBB tube, made by the company OCP, using a full caliber projectile with a projectile weight of 150 g and an ignition on the basis of 340 mg nitrocellulose (threaded percussion primer ZSX 296-2 by OCP). With a charge weight of 139 g, the resulting muzzle speed is 1273 m/s and the maximum gas pressure is 2793 bar at a temperature of 21° C. A temperature of −54° C. results in a speed of 1114 m/s at a pressure of 2032 bar and a temperature of +71° C. results in a speed of 1377 m/s at a pressure of 3550 bar. At 21° C., the ratio of muzzle speed to maximum gas pressure ($V_o/P_{max}$) is 0.456.

For comparison purposes, a conventionally produced, homogeneously composed propellant powder with similar dimensions and formula components as the previously mentioned powder with layered composition, which is to be protected, is fired from the same weapon system or ammunition system. The 7-hole comparison propellant has an outside diameter of 3.87 mm, a length of 4.05 mm, an average hole diameter of 0.15 mm, a density of 1.63 g/ml as well as an explosion heat of 3791 J/g and is composed of the following formula components: RDX with an average grain size of 5 micrometers (20%), acardit-II (1.0%), calcium carbonate (0.4%), potassium sulfate (0.6%), as well as 20% of a mixture of 60% methyl-NENA (compound I, $R_1$=methyl) and 40% ethyl-NENA (compound I, $R_1$=ethyl) and 57% nitrocellulose with a nitrogen content of 12.6%.

The same 25-mm KBB ammunition configuration as before is used to fire this comparison powder. Given a charge weight of 140 g, a muzzle speed of 1119 m/s at a maximum gas pressure of 2895 bar is obtained at 21° C. At -54° C., a speed of 1053 m/s at a maximum gas pressure of 2649 bar is obtained and at +71° C. a speed of 1191 m/s at a maximum gas pressure of 3275 bar. The ratio of muzzle speed to maximum gas pressure ($V_o/P_{max}$) is 0.386 at 21° C.

With 1 g less charge weight, similar values for the explosion heat and similar formula components, the maximum gas pressure at 21° C. of the propellant to be protected, which has a layered grain composition, is lower by 102 bar while the muzzle speed is higher by 154 m/s. This expresses itself in a clearly better, higher $V_o/P_{max}$ ratio relative to the comparison propellant. As a result of the layered grain composition, a kinetic muzzle energy increase of 30.4% is possible with analog values for the explosion heat (=same tube erosion) and the maximum gas pressure.

EXAMPLE 5

Production Process in a Watery Emulsion

As in Example 1, 4.65 kg of a 7-hole green propellant with an outside diameter of 2.65 mm, a length of 3.06 mm and an average hole diameter of 0. 16 mm, composed of the solid components 1.2% acardit-II, 0.2% calcium carbonate, 1.4% potassium sulfate and 97.2% nitrocellulose with a nitrogen content of 13.15%, is initially treated with 0.35 kg nitroglycerin dissolved in 1.4 kg ethanol and is then treated with 60 g Paraplex G 54. The propellant obtained in accordance with the process used for Example 1, has a bulk density of 1074 g/l with an explosion heat of 3991 J/g. The flame temperature for this propellant is at 3070 K (computation by means of ICT code).

A muzzle speed of 1378 m/s at a maximum gas pressure of 4209 bar can be achieved at 21° C. with a 25 mm tube weapon and a sub-caliber APDS projectile weighing 132 g and a charge weight of 101.0 g. At −54° C., the muzzle speed is 1298 m/s at a pressure of 3356 bar and at 71° C., the speed is 1375 m/s at a pressure of 4384 bar.

The resulting kinetic muzzle energy is 1241 m/s and the thermal degree of effectiveness is therefore 0.311.

EXAMPLE 6

Propellant with Energetic Plasticizer

As for Example 1, 4.7 kg of a 7-hole green propellant with an outside diameter of 2.39 mm, a length of 2.77 mm and an average hole diameter of 0.16 mm, composed of the solid components 1.2% acardit-II, 0.2% calcium carbonate, 1.4% potassium sulfate and 97.2% nitrocellulose with a nitrogen content of 13.15%, is treated with 0.3 kg of butyl-NENA (compound I, $R_1$=n-butyl), dissolved in 1.2 kg ethanol. The resulting propellant powder has a bulk density of 1030 g/l with an explosion heat of 3826 J/g. The flame temperature computed with the ICT code is at 2946 K.

At a temperature of 21° C., a muzzle speed of 1391 m/s at a maximum gas pressure of 4396 bar can be achieved with a 25 mm tube weapon and a sub-caliber APDS projectile weighing 132 g and having a charge weight of 101.5 g. At -54° C., the muzzle speed is 1361 m/s at a pressure of 3849 bar, while at 71° C., the muzzle speed is 1327 m/s at a pressure of 4062 bar.

This results in a kinetic muzzle energy of 1258 m/s with a thermal degree of effectiveness of 0.329.

As compared to the reference in Example 5, the thermal degree of effectiveness is higher by 5.8% and the kinetic muzzle energy is higher by 1.4%.

Owing to the fact that the values for the explosion heat (−165 J/g) and the flame temperature (−124 K) are considerably lower for Example 6 than for Example 5, a noticeable improvement in the tube burnout (tube erosion) can be expected.

It must be noted that compared to the Example 5, an analog kinetic muzzle energy can be realized with the embodiment according to Example 6, which is to be protected, but with clearly lower values for the heat of explosion and the flame temperature.

In summary, it can be said that in addition to the method for producing propellant powders that are known per se, new types of propellant powders are suggested, in which the known blasting oils NGL and DEGN are replaced by sensitivity reducing energetic plasticizing agents; NGL is nitroglycerine and DEGN is diethylene glycol dinitrate. These propellants are less sensitive to vibrations. Crystalline energy carriers can be added to the grain matrix to optimize the performance.

As compared to normal propellants, the resulting propellants with a layered compositions have increased performance level and a balanced temperature behavior, event though they are fully system compatible. The propellants are easier to produce as compared to the dibasic propellants and do not exhibit the disadvantageous burning qualities (tube erosion) of nitramine-containing propellants.

The invention claimed is:

1. A method for producing a functional, high-energetic material having a layered grain structure and containing an energetic plasticizer and a polymeric desensitizer, comprising the steps of:

providing a receptive grain in water;

adding an energetic plasticizer in the form of a solution to said receptive grain in water;

providing a first diffusion step by selecting adding times, exposure times and/or pressure lowering moments such that diffusion of said energetic plasticizer into said receptive grain is effected to a depth of at least 100 μm and at a maximum of 500 μm in order to produce a layered structure of said energetic plasticizer;

then after said diffusion of said energetic plasticizer providing a polymeric desensitizer in the form of an emulsion comprising water to said receptive grain, wherein said polymeric desensitizer is an organic ester or ether with a molecular weight of 100 to 100000;

providing a second diffusion step by selecting adding times, exposure times and/or pressure lowering moments such that diffusion of said polymeric desensitizer into said receptive grain is effected to a depth of at least 100 μm and at a maximum of 500 μm in order to produce a layered structure of said polymeric desensitizer; and after said diffusion of said polymeric desensitizer, polishing said grain with graphite.

2. The method according to claim 1, wherein the receptive grain comprises at least 80% nitrocellulose with a nitrogen content of 11-13.5%.

3. The method according to claim 1, wherein the receptive grain has a cylindrical structure with a diameter to length ratio of between 0.5 and 2.0, an outside diameter between 0.5 and 10 mm and contains at least one hole.

4. The method according to claim 3, wherein said at least one hole has a hole diameter between 0.03 and 0.7 mm.

5. The method according to claim 1, which further comprises producing the receptive grain by compressing a solvent-containing powder dough of nitrocellulose in a molding press or by extruding it, wherein the solvent-containing powder dough contains at least one substance with the general structure

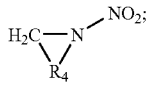

(III)

wherein $R_4$=(—$CH_2$—N—$NO_2$)$_n$ and n=2 or 3, wherein said at least one substance is present in an amount of 5-80% based on a dry weight of the powder dough.

6. The method according to claim 5, wherein said at least one substance has a structure selected from the group consisting IV, V and VI, wherein IV is

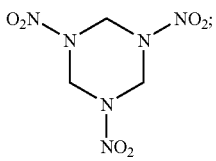

(IV)

wherein V is

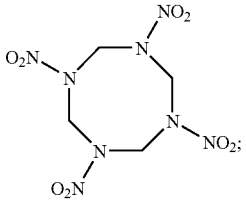

(V)

and wherein VI is

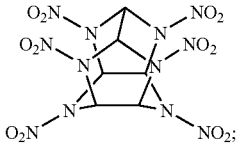

(VI)

and wherein the said at least one substance is present in the absorbent grain in an amount which is between 10-60%.

7. The method according to claim 1, further comprising the steps of:

adding the energetic plasticizer in an organic solvent to a mixture of receptive grains in water; and admixing the polymeric desensitizer in water.

8. The method according to claim 7, wherein the adding of the energetic plasticizer and the admixing of the polymeric desensitizer in water is undertaken at a temperature between 20-85° C.

9. The method according to claim 8, further comprising:

pre-soaking receptive grains in an organic solvent in a reactor; and stirring during a period of 4-24 hours at a temperature of 20-85° C. prior to adding the solution or emulsion of energetic plasticizer, which is liquid at room temperature.

10. The method according to claim 7, wherein the receptive gains are placed into 1 to 5 times the amount by weight of water.

11. The method according to claim 7, which is conducted in a reactor tank, wherein after the step of admixing the polymeric desensitizer, the pressure in the reactor tank is reduced to 400-800 mbar during a period of 2-6 hours to allow liquid components to drain out through a strainer in a bottom of the reactor tank; and a resulting powder mass is dried with warm air.

12. The method according to claim 11, wherein, after drying the resulting powder mass, 0.01-2% graphite is added in a polishing drum to the powder mass to obtain a bulk propellant powder with a bulk density >1000 g/l.

13. The method according to claim 1, wherein the energetic plasticizer is selected from the group consisting of nitroglycerine, diethylene glycol dinitrate, a substance with the structure (I)

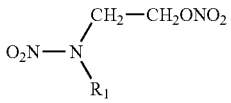

and a substance with the structure (II)

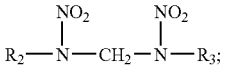

wherein $R_1$=$C_1$-$C_{10}$-alkyl, $C_1$-$C_{10}$-alkoxy or aryl, $R_2$ and $R_3$ are each independent of each other and each is a $C_1$-$C_5$-alkyl or $C_1$-$C_5$-alkoxy; and wherein the energetic plasticizer is added in an amount of 5-20% relative to the receptive grains.

14. The method according to claim 13, wherein the energetic plasticizer is selected from the group consisting of the following structures:

(I)

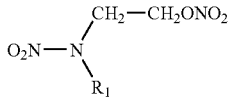

and (II)

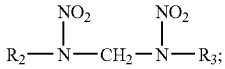

wherein $R_1$=$C_1$-$C_4$ alkyl, methyl, ethyl, n-propyl, i-propyl, n-butyl, i-butyl, or t-butyl, and $R_2$ and $R_3$ are independent of each other and each is a $C_{1-2}$ alkyl.

15. The method of claim 14, wherein each of $R_2$ and $R_3$ is independently methyl.

16. The method of claim 14, wherein $R_1$ is alkyl, methyl, ethyl, n-propyl, i-propyl, n-butyl, i-butyl, or t-butyl.

17. The method of claim 15 wherein $R_1$ is alkyl, methyl, ethyl, n-propyl, i-propyl, n-butyl, i-butyl, or t-butyl.

* * * * *